US008254211B2

(12) United States Patent
Tanabe

(10) Patent No.: US 8,254,211 B2
(45) Date of Patent: Aug. 28, 2012

(54) ELECTRONIC DEVICE AND CONTROL METHOD THEREFOR

(75) Inventor: Takuya Tanabe, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 310 days.

(21) Appl. No.: 12/797,204

(22) Filed: Jun. 9, 2010

(65) Prior Publication Data

US 2010/0315907 A1 Dec. 16, 2010

(30) Foreign Application Priority Data

Jun. 15, 2009 (JP) ..... 2009-142493

(51) Int. Cl.
*G04C 11/02* (2006.01)

(52) U.S. Cl. ..... 368/47

(58) Field of Classification Search ..... 368/47
See application file for complete search history.

(56) References Cited

U.S. PATENT DOCUMENTS

| | | | | |
|---|---|---|---|---|
| 7,728,811 | B2 * | 6/2010 | Albert et al. | 345/107 |
| 7,830,591 | B2 * | 11/2010 | Shimodaira | 359/296 |
| 2007/0159928 | A1 * | 7/2007 | Nirasawa | 368/47 |

FOREIGN PATENT DOCUMENTS

| | | |
|---|---|---|
| JP | 2002-277575 | 9/2002 |
| JP | 2004-093375 | 3/2004 |
| JP | 2004-109016 | 4/2004 |
| JP | 2007-187504 | 7/2007 |
| JP | 2009-128044 | 6/2009 |

* cited by examiner

*Primary Examiner* — Renee Luebke
*Assistant Examiner* — Jason Collins

(57) ABSTRACT

An electronic device that receives a radio signal according to specific conditions and displays specific information, including a reception unit that receives the radio signal; an electrophoretic display unit that displays the specific information; a display drive unit that supplies a drive signal corresponding to content of the specific information to be displayed to the electrophoretic display unit; and a control unit that instructs the reception unit to receive the radio signal and instructs the display drive unit to supply the drive signal to the electrophoretic display unit, instructs the display drive unit to supply a drive signal for displaying an indication that the reception unit is receiving the radio signal to the electrophoretic display unit before instructing the reception unit to receive the radio signal, and controls the display drive unit to stop supplying the drive signal while the reception unit is receiving the radio signal.

7 Claims, 11 Drawing Sheets

ELECTRONIC DEVICE AND CONTROL METHOD THEREFOR

CROSS-REFERENCE TO RELATED APPLICATIONS

Japanese Patent application No. 2009-142493, filed Jun 15, 2009, is hereby incorporated by reference in its entirety.

BACKGROUND

1. Field of Invention

The present invention relates to an electronic device that uses an electrophoretic display device, and to a control method therefor.

2. Description of Related Art

In electronic devices, and particularly in small electronic devices, that receive radio frequency signals, signals from electronic circuits are a latent source of noise for the receiver because the receiver and the electronic circuits are integrated in a confined space. As a result, methods of enabling reception with good sensitivity by stopping the electronic circuits in order to suppress noise output have been proposed. For example, the radio-controlled timepiece taught in Japanese Unexamined Patent Appl. Pub. JP-A-2004-109016 relates to a radio-controlled timepiece that can reduce the effect of noise from a liquid crystal display (LCD) device when receiving RF signals. As a result, the effect of noise on reception sensitivity can be reduced by receiving RF signals only during dark or nighttime conditions when turning the LCD device off is not a problem.

With the radio-controlled timepiece taught in JP-A-2004-109016, however, the LCD screen never functions as a display unit during signal reception because the LCD device is turned off. The conditions suitable for receiving RF signals are therefore limited to when it is dark. However, if the time displayed by the radio-controlled timepiece is incorrect, it is commonly desirable to manually receive the RF time signal during normal daylight conditions. If the radio-controlled timepiece taught in JP-A-2004-109016 is used this way, the user may think that the radio-controlled timepiece has malfunctioned even though signals are actually being received.

SUMMARY OF INVENTION

An electronic device and control method therefor according to the present invention enable reducing the effects of noise and receiving RF signals while also enabling the user to know that signals are being received.

A first aspect of the invention is an electronic device that receives a radio signal according to specific conditions and displays specific information, including a reception unit that receives the radio signal; an electrophoretic display unit that displays the specific information; a display drive unit that supplies a drive signal corresponding to content of the specific information to be displayed to the electrophoretic display unit; and a control unit that instructs the reception unit to receive the radio signal and instructs the display drive unit to supply the drive signal to the electrophoretic display unit, instructs the display drive unit to supply a drive signal for displaying an indication that the reception unit is receiving the radio signal to the electrophoretic display unit before instructing the reception unit to receive the radio signal, and controls the display drive unit to stop supplying the drive signal while the reception unit is receiving the radio signal.

The electrophoretic display unit of the invention can continue displaying the displayed content even after the display drive unit stops supplying the drive signal. Before instructing the reception unit to receive the radio signal, the control unit controls the display drive unit to supply a drive signal for displaying content indicating that reception is in progress. As a result, the invention can continue displaying information informing the user that reception is in progress even if the control unit stops the drive signal supply from the display drive unit while signal reception is in progress.

For example, an electronic device that uses a liquid crystal display screen cannot continue displaying information on the screen while supplying the drive signal to the LCD screen is stopped. As a result, the radio-controlled timepiece taught in JP-A-2004-109016 must interrupt the screen display and receive radio signals when it is dark. The invention, however, enables stopping supplying the drive signal that can cause noise to the electrophoretic display unit whether it is light or dark and can receive signals with high reception sensitivity while the displayed indication that reception is in progress prevents the user from thinking a device failure has occurred.

An electronic device according to another aspect of the invention also has a power supply unit that supplies electric power to the display drive unit. In this aspect of the invention the control unit stops the display drive unit from supplying the drive signal while the reception unit is receiving the radio signal by instructing the power supply unit to stop supplying power to the display drive unit.

With this aspect of the invention information telling the user that reception is in progress can continue to be displayed when supplying the drive signal is stopped by stopping the supply of power to the display drive unit. Because power is thus not supplied to the display drive unit, power consumption by the electronic device can also be reduced.

In an electronic device according to another aspect of the invention the electrophoretic display unit can display at least a first color and a second color; and the first color or the second color is displayed over the entire display to indicate that signal reception is in progress.

Because the specific color presented in the full-screen display of the specific color that indicates reception is in progress is either the first color or the second color, that is, one of the basic colors that can be displayed by the electrophoretic display unit, the appearance of the display can be prevented from degrading due to a drop in contrast even when the supply of drive signals from the display drive unit is stopped for a long time.

For example, a two-particle microcapsule type electrophoretic display system may have a colorless, transparent suspension fluid containing black and white electrophoretic particles. This type of electrophoretic display unit can display at least two colors using the two basic colors of black and white. In this configuration white, which is one of the electrophoretic particle colors, may be assigned as the first color, and black may be assigned as the second color.

If the first color is then displayed on the electrophoretic display unit by applying a voltage to the electrophoretic particles, and supplying the drive signal is then stopped for a long time, some of the electrophoretic particles of the first color may migrate toward the center of the electrophoretic elements (microcapsules) from near the common electrode of the electrophoretic display unit that is viewed by the user. Even in this situation, however, the first color will continue to be displayed on the electrophoretic display unit because electrophoretic particles of the first color accumulate in multiple layers near the common electrode of the electrophoretic display unit. The appearance of the display can therefore be prevented from degrading due to a drop in contrast even when the supply of drive signals from the display drive unit is stopped for a long time.

In an electronic device according to another aspect of the invention the electrophoretic display unit can display at least a first color, a second color, and an intermediate color of the first color and second color, and the intermediate color is displayed over the entire display to indicate that signal reception is in progress.

Because the specific color presented in the full-screen display of the specific color that indicates reception is in progress is an intermediate color, the change in the displayed color resulting from electrophoretic particle migration is difficult for the user to perceive even when the supply of drive signals from the display drive unit is stopped for a long time.

The appearance of the display can therefore be prevented from degrading.

For example, a two-particle microcapsule type electrophoretic display system may have black and white electrophoretic particles. This type of electrophoretic display unit can display at least one intermediate color (gray) in addition to white as the first color and black as the second color.

If a single intermediate color is then displayed on the electrophoretic display unit by applying a voltage to the electrophoretic particles, and supplying the drive signal is then stopped for a long time, some of the electrophoretic particles may migrate toward the center of the electrophoretic elements (microcapsules). This may result in a change in the color displayed on the electrophoretic display unit, but this color change is from one gray level to another gray level and is difficult for the user to detect. The appearance of the display can therefore be prevented from degrading even when the supply of drive signals from the display drive unit is stopped for a long time.

An electronic device according to another aspect of the invention preferably also has a timekeeping unit for keeping the current time. In this aspect of the invention the reception unit receives a radio signal containing time information; the electrophoretic display unit displays the current time as the specific information; and the control unit adjusts the current time kept by the timekeeping unit based on the received time information, and controls the display drive unit to resume supplying the drive signal related to displaying the current time after the reception unit completes reception of the radio signal, when acquisition of the time information by the reception unit is determined successful.

With this aspect of the invention an electronic device, such as a radio-controlled timepiece, that has a function for displaying the current time can display the correct time based on the time information contained in the radio signal when the time information is successfully acquired.

In an electronic device according to another aspect of the invention the electrophoretic display unit is an electrophoretic display panel that has an electrophoretic display layer containing electrophoretic elements disposed between a common electrode layer where a common electrode is formed, and a drive electrode layer where a drive electrode for driving the electrophoretic display layer is formed. The display drive unit supplies common electrode drive pulses repeating a first potential and a second potential to the common electrode; and the control unit controls the display drive unit to stop supplying the common electrode drive pulses while the reception unit is receiving the radio signals.

By stopping the common electrode drive pulses that can be a major cause of noise during signal reception, this aspect of the invention enables high sensitivity signal reception in an electronic device that uses an electrophoretic display panel driven by a display drive unit supplying common electrode drive pulses.

Another aspect of the invention is a control method for an electronic device that uses a reception unit to receive radio signals and displays specific information on an electrophoretic display unit by means of a drive signal supplied from a display drive unit, including steps of: instructing the reception unit to receive the radio signal, and instructing the display drive unit to supply the drive signal to the electrophoretic display unit; and instructing the display drive unit to supply a drive signal for displaying an indication that the reception unit is receiving the radio signal to the electrophoretic display unit before instructing the reception unit to receive the radio signal, and controlling the display drive unit to stop supplying the drive signal while the reception unit is receiving the radio signal, when the reception unit is instructed to receive the radio signal.

Before instructing the reception unit to receive the radio signal, this aspect of the invention supplies a drive signal for displaying information indicating that reception is in progress to the electrophoretic display unit, and controls the display drive unit to stop supplying the drive signal while the reception unit is receiving the radio signal. By thus controlling operation, information telling the user that reception is in progress can continue to be displayed even when supplying the drive signal of the display drive unit is stopped during signal reception. Supplying the drive signal that can cause noise to the electrophoretic display unit can therefore be stopped and signals can be received with high reception sensitivity while the displayed indication that reception is in progress prevents the user from thinking a device failure has occurred.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
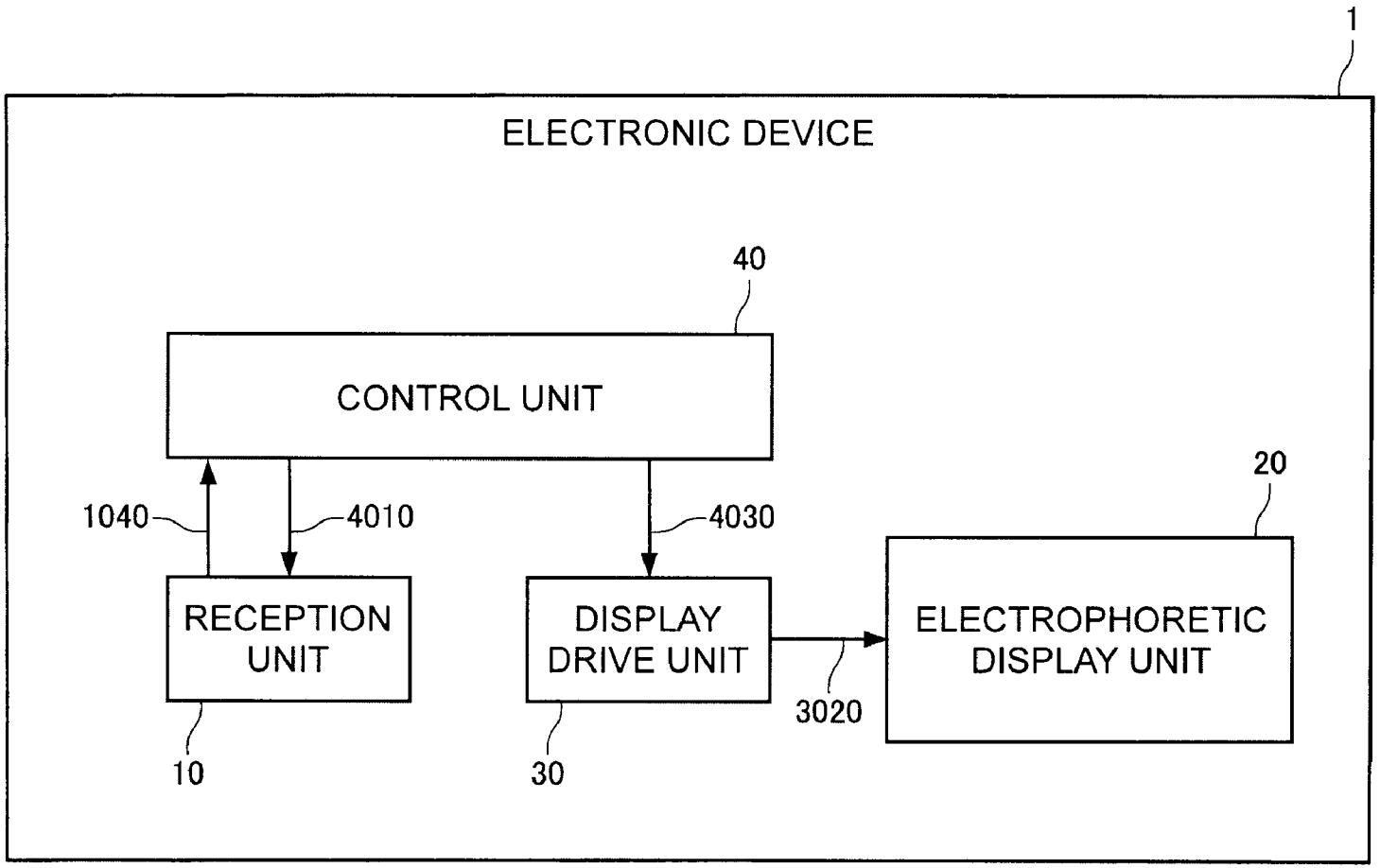
FIG. 1 a block diagram of an electronic device according to a preferred embodiment of the invention.

FIG. 1 a block diagram of an electronic device according to a preferred embodiment of the invention.

The electronic device 1 has a reception unit 10. The reception unit 10 receives radio frequency signals needed by the electronic device based on the control content of a reception control signal 4010 from a control unit 40. The reception unit 10 outputs radio signal information 1040 from the received radio signal to the control unit 40. The radio signal information 1040 may be all of the information contained in the radio signal or only the part of the information needed by the control unit 40. Note, further, that the radio signal is not limited to short wave signals, long wave signals, or other signals of a particular wavelength. In addition, the radio signal contains information that is needed by the electronic device 1, and this information is not limited to time information or other such specific information. The transmission source of the radio signal may be a facility such as a standard signal transmitter, or it may be another electronic device (terminal device).

The electronic device 1 also has an electrophoretic display unit 20. The electrophoretic display unit 20 displays supplied information to the user according to a drive signal 3020 from the display drive unit 30, and also has a user interface function.

The electrophoretic display unit 20 can be rendered by an electrophoretic display device. Electrophoretic display devices generally provide better legibility with less eye fatigue than CRT and LCD devices, and offer superior portability because they can be bent. Another feature of electrophoretic display devices is that a displayed pattern can be kept on screen by stopping applying a potential to the common electrode and segment electrode (or pixel electrode) (such as be setting each electrode to a high impedance state) after the desired display pattern has been formed on an electrophoretic display device.

The electrophoretic display unit 20 has these features, and may be a segment or active matrix display device. Yet further, the electrophoretic display unit 20 may use a microcapsule type electrophoresis system, an in-plane electrophoresis system, or a vertical electrophoresis system, for example, and if a microcapsule system is used, either a two-particle or one-particle system may be used.

The electronic device 1 also has a display drive unit 30. The display drive unit 30 supplies the drive signal 3020 to the electrophoretic display unit 20 according to the commands in the display drive control signal 4030 from the control unit 40. The drive signal 3020 corresponds to the content of the information to be displayed on the electrophoretic display unit 20.

The electronic device 1 also has a control unit 40. The control unit 40 controls by means of the display drive control signal 4030 the timing at which the display drive unit 30 supplies and stops supplying the drive signal 3020 to the electrophoretic display unit 20. The control unit 40 also controls the timing of radio signal reception by the reception unit 10 by means of the reception control signal 4010. Using the reception control signal 4010 and the display drive control signal 4030, the control unit 40 instructs the display drive unit 30 to supply a drive signal 3020 to the electrophoretic display unit 20 to display information indicating that the reception unit 10 is receiving an RF signal before instructing the reception unit 10 to receive the signal, and controls the display drive unit 30 to stop supplying the drive signal 3020 while the reception unit 10 is receiving the radio signal.

The electrophoretic display unit 20 can continue displaying the displayed content after the display drive unit 30 stops supplying the drive signal 3020 thereto. As a result, by instructing the display drive unit 30 to supply a drive signal 3020 to display an indication that reception is in progress before the control unit 40 instructs the reception unit 10 to receive the radio signal by means of the reception control signal 4010, the electrophoretic display unit 20 can continue displaying an indication to the user that reception is in progress even though the display drive unit 30 stops supplying the drive signal 3020 while reception is in progress.

As a result, supplying an electrophoretic display unit 20 drive signal 3020 that can cause noise can be stopped and signals can be received with high sensitivity while continuing to display content that can prevent the user from wondering if a device failure has occurred.

A preferred embodiment of an electronic device according to the invention is described in detail below using a radio-controlled timepiece that receives signals containing standard time information as an example of the electronic device.

1. Embodiment 1

Figure 2:
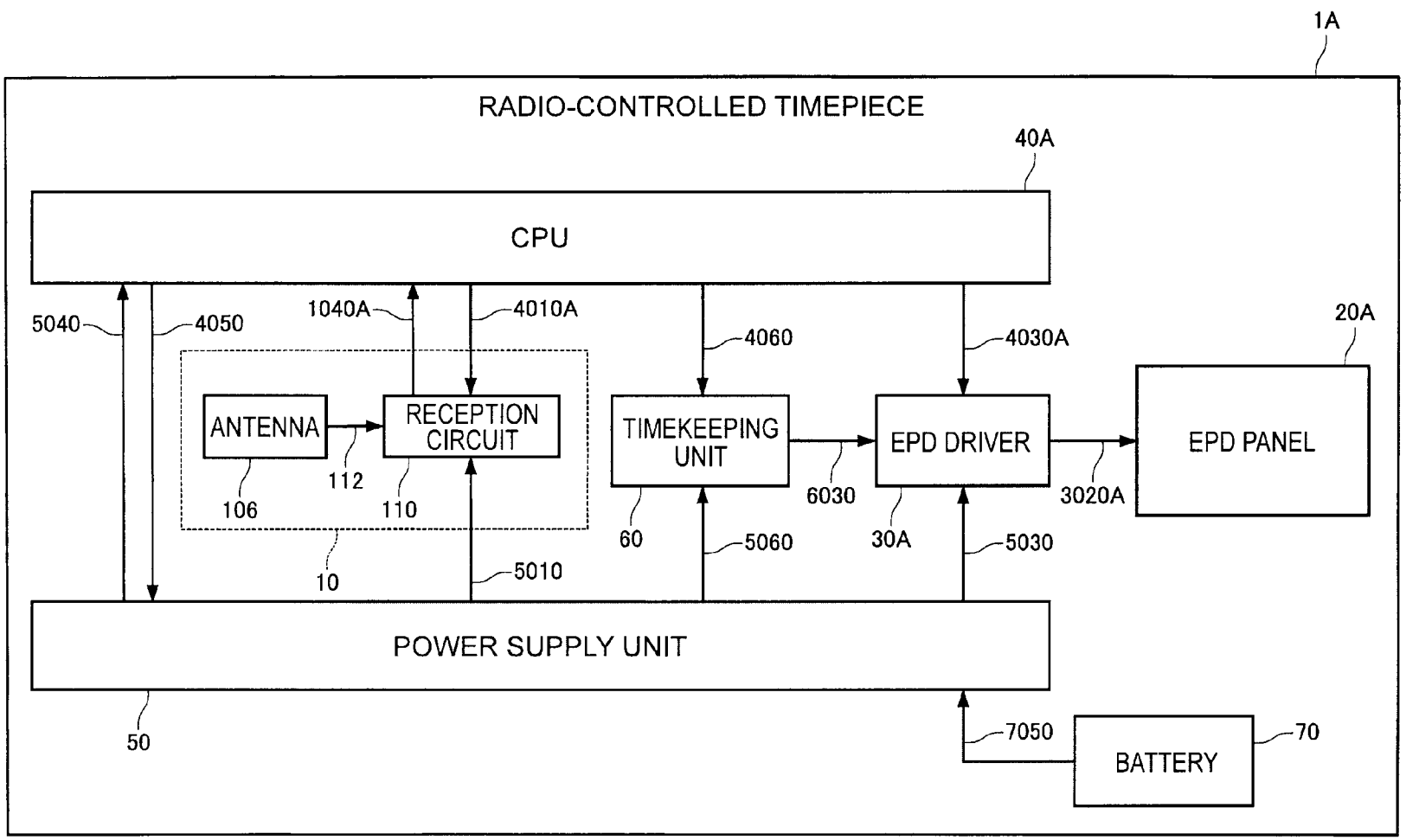
FIG. 2 is a block diagram of a radio-controlled timepiece according to a first embodiment of the invention.

FIG. 2 is a block diagram of a radio-controlled timepiece according to a first embodiment of the invention. This radio-controlled timepiece 1A corresponds to the electronic device 1 in FIG. 1.

The radio-controlled timepiece 1A has a reception unit 10 that includes an antenna 106 and a reception circuit 110. The antenna 106 receives and supplies the RF signals required by the radio-controlled timepiece 1A to the reception circuit 110 as an internal reception unit signal 112. In this first embodiment of the invention the radio signal is, for example, a long-wave standard time signal. The long-wave standard time signal contains a time code 1040A carrying time information. More specifically, information about the hour, minute, date, year, and weekday is contained in the time code 1040A. Note that the CPU 40A can appropriately acquire the required information from the time code 1040A, and can correct the hour, minute, date, year, weekday, or other information kept in the radio-controlled timepiece 1A as needed.

The radio-controlled timepiece 1A has an EPD (electrophoretic display) panel 20A. The EPD panel, that is, the electrophoretic display panel 20A, corresponds to the electrophoretic display unit 20 shown in FIG. 1. In this first embodiment of the invention the EPD panel 20A is, for example, a two-particle microcapsule electrophoretic display device. The EPD panel 20A also displays time information and date information using a segment display system, for example.

The radio-controlled timepiece 1A also has an EPD (electrophoretic display) driver 30A. The EPD driver 30A corresponds to the display drive unit 30 shown in FIG. 1. The EPD driver 30A supplies a drive signal 3020A to the EPD panel 20A according to the commands in a display drive control signal 4030A from the CPU 40A. The drive signal 3020A correlates to the time information or other content to be displayed on the EPD panel 20A.

The radio-controlled timepiece 1A also has a CPU 40A. The CPU 40A corresponds to the control unit 40 in FIG. 1. The CPU 40A controls the timing at which the EPD driver 30A supplies and stops supplying the drive signal 3020A by means of the display drive control signal 4030A. The CPU 40A also controls the timing when the antenna 106 receives the long-wave standard time signal by means of a reception control signal 4010A. In this first embodiment of the invention the CPU 40A instructs the reception circuit 110 to receive. Next, the internal reception unit signal 112 is supplied from the antenna 106 to the reception circuit 110.

The radio-controlled timepiece 1A also has a timekeeping unit 60. The radio-controlled timepiece 1A keeps the time information displayed on the EPD panel 20A by means of the timekeeping unit 60. The timekeeping unit 60 supplies the kept time information as a timekeeping information signal 6030 to the EPD driver 30A. At this time the CPU 40A can correct the time kept by the timekeeping unit 60 using a timekeeping control signal 4060 based on the time code 1040A. This adjustment enables always displaying the correct time on the EPD panel 20A.

The timekeeping information signal 6030 may alternatively be supplied through the CPU 40A to the EPD driver 30A. Instead of the CPU 40A indirectly correcting the time kept by the timekeeping unit 60 by means of the timekeeping control signal 4060 as described above, the CPU 40A in this configuration may directly correct the timekeeping information signal 6030 before supplying it to the EPD driver 30A.

The radio-controlled timepiece 1A also has a power supply unit 50 and a battery 70. The power supply unit 50 receives supply power 7050 from the battery 70, which is the power source, and supplies power (5010, 5030, 5040, 5060) to the reception unit 10, the EPD panel 20A, the EPD driver 30A, the CPU 40A, and the timekeeping unit 60. The CPU 40A can turn the power supply (5010, 5030, 5040, 5060) to each of the powered devices on/off by means of a power supply control signal 4050. By stopping the power supply to individual function blocks (10, 20A, 30A, 40A, 60), noise from a particular function block can be suppressed and power consumption can be reduced. Note that the battery 70 may be a primary battery or a secondary battery (storage battery) such as a lithium ion battery. In this first embodiment of the invention the battery 70 is a secondary battery, and the battery 70 is charged by power produced by a solar cell (not shown in the figure) and supplies the necessary power to the radio-controlled timepiece 1A.

In the first embodiment of the invention the time information or other content displayed on the EPD panel 20A is determined by the drive signal 3020A supplied from the EPD driver 30A. Before instructing the reception circuit 110 to receive the radio signal by means of the reception control signal 4010A, the CPU 40A instructs the EPD driver 30A by means of the display drive control signal 4030A to supply the drive signal 3020A related to displaying an indication that reception is in progress. The CPU 40A then instructs the power supply unit 50 by means of the power supply control signal 4050 to stop the power supply 5030 to the EPD driver 30A. Supplying the drive signal 3020A thus stops, but the user can know from the content that continues to be displayed on the EPD panel 20A that reception is in progress.

Figure 3B:
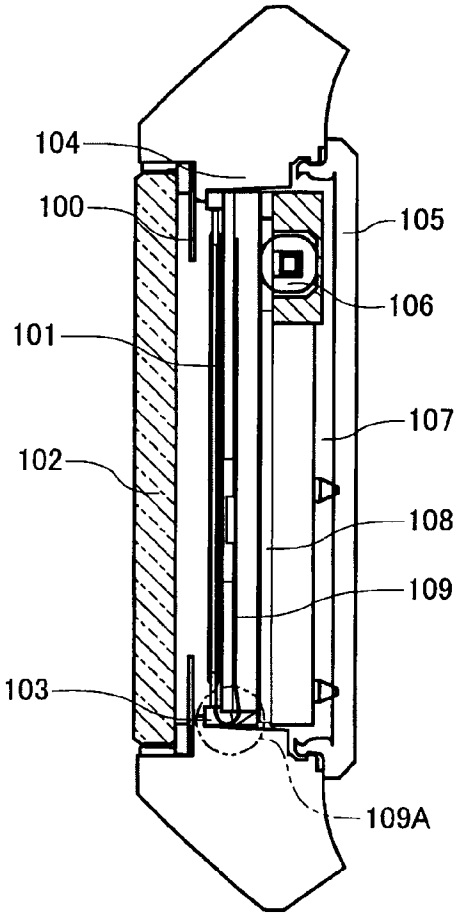
FIG. 3B is a section view showing the inside of the radio-controlled timepiece according to a first embodiment of the invention.
Figure 3A:
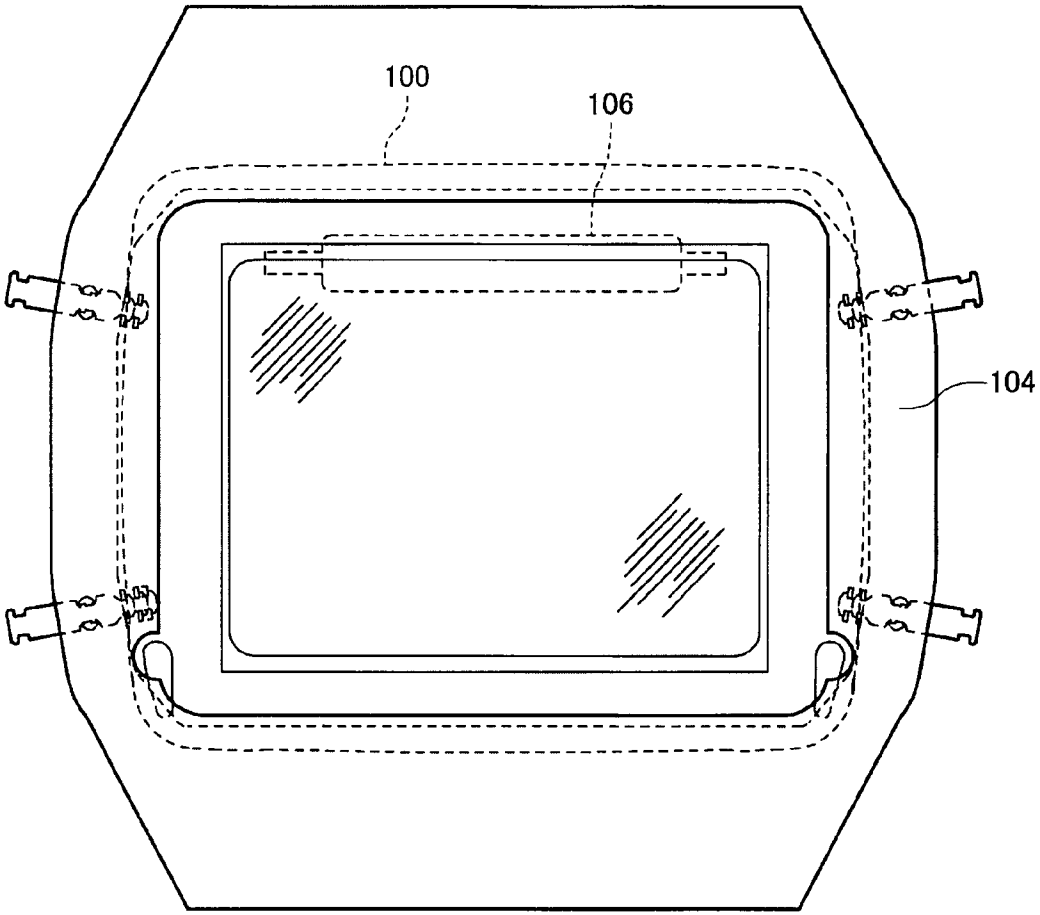
FIG. 3A is a front view of a radio-controlled timepiece according to a first embodiment of the invention.

FIG. 3A is a front view showing the appearance of a radio-controlled timepiece according to the first embodiment of the invention. FIG. 3B is a section view through a line connecting the 12:00 o'clock and 6:00 o'clock positions of the radio-controlled timepiece in FIG. 3A. FIG. 3A is a view from the crystal 102 of the timepiece in FIG. 3B, and the back cover 105 side of the timepiece is not shown in FIG. 3A. The antenna 106 shown in FIG. 3A and FIG. 3B corresponds to the antenna 106 in FIG. 2. The display circuit board 101 includes all of the EPD panel 20A and part of the EPD driver 30A.

Part of the display substrate 101 in FIG. 3B is a flexible printed circuit, and is housed together with the display substrate 109 that folded back at the flexible printed circuit in the case 104. The overlapping display substrate 109 includes part of the EPD driver 30A. The radio-controlled timepiece according to the first embodiment of the invention uses a solar cell 100 that is secured by a solar cell clamp 103, and the storage battery (battery 70 in FIG. 2) is charged by the power generated by the solar cell 100. The circuit block 108 is held by a circuit clamp 107, and includes the CPU 40A, the timekeeping unit 60, the reception circuit 110, and part of the power supply unit 50.

In a radio-controlled timepiece such as shown in FIG. 3A the antenna 106 is disposed near the back cover 105 behind the display substrate 101 as seen from the front. The back cover 105 is generally metal, and radio signals cannot be expected to pass through the back cover 105 and reach the antenna 106.

Therefore, radio signals are received by the antenna 106 after passing through the crystal 102, the display substrate 101, and the display substrate 109 that is folded back. There is limited freedom in the location of the antenna 106 because of the need to reduce size. It is therefore necessary in a radio-controlled timepiece such as shown in FIG. 3A to maximize the signal reception sensitivity of the antenna 106. Note that the need to improve reception sensitivity because of the limited paths enabling radio signals to reach the reception unit is not limited to radio-controlled timepieces, and applies to increasingly smaller electronic devices in general.

In order to improve the reception sensitivity of the antenna 106, it is also conceivable to omit all electrical wiring that might produce noise from proximity to the antenna 106. The drive signal applied to an EPD panel in particular can easily result in noise because of the high required supply voltage, that is, +15 V. More specifically, in the configuration of a radio-controlled timepiece shown in FIG. 3A and FIG. 3B, for example, the display substrate 101 and the overlapping display substrate 109 can be moved toward 6:00 o'clock to maximize the distance from the antenna 106 located near 12:00 o'clock. In this configuration wiring is concentrated in the folded part 109A connecting the display substrate 101 with the overlapping display substrate 109. As a result, the folded part 109A is near 6:00 o'clock opposite the antenna 106 (located near 12:00 o'clock).

However, how far the antenna 106 and the display substrates 101, 109 can be separated is limited in a radio-controlled timepiece and small electronic devices. In addition, reducing the size of the EPD panel 20A contained in the display substrate 101 runs counter to the desire to improve legibility for the user. Stopping the EPD drive signal during signal reception is therefore a particularly effective way to improve the signal reception sensitivity of the antenna 106.

Figure 4:
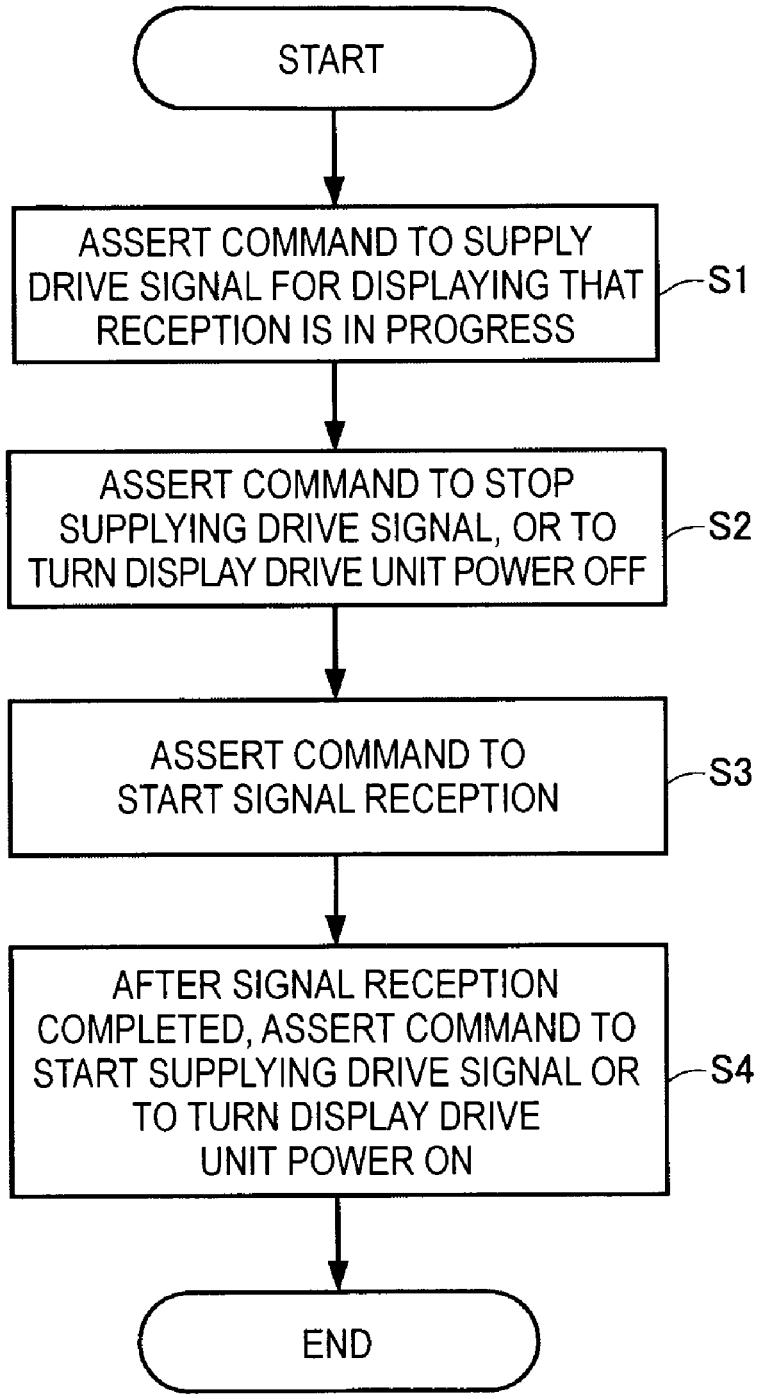
FIG. 4 is a flow chart of the control unit in the first embodiment of the invention.

FIG. 4 is a flow chart describing the control process executed by the CPU 40A shown in FIG. 2 corresponding to the control unit 40 in FIG. 1 in the first embodiment of the invention.

First, before inputting the reception control signal 4010A to instruct the reception unit 10 to start signal reception, the CPU 40A instructs the EPD driver 30A to supply the drive signal 3020A for displaying an indication that reception is in progress to the EPD panel 20A (S1).

The CPU 40A then controls the EPD driver 30A to stop supplying the drive signal 3020A while the reception unit 10 is receiving signals (first step in S2). Note that the CPU 40A is not limited to thus directly stopping the drive signal 3020A, and may alternatively indirectly stop the drive signal 3020A by using the power supply control signal 4050 to instruct the power supply unit 50 to stop the power supply 5030 to the EPD driver 30A (second step in S2).

The CPU 40A then instructs the reception unit 10 to start signal reception by means of the reception control signal 4010A (S3).

After the reception unit 10 completes signal reception, the CPU 40A instructs the EPD driver 30A to start supplying the drive signal 3020A by means of the display drive control signal 4030A (first part in S4). Note that if the drive signal 3020A was stopped indirectly by stopping the power supply 5030, the CPU 40A tells the power supply unit 50 to start the power supply 5030 by means of the power supply control signal 4050. Supplying the drive signal 3020A thus resumes (second part in S4).

Note that completion of signal reception by the reception unit 10 can be determined from the content of the time code 1040A, by the reception circuit 110 contained in the reception unit 10 adding a flag indicating reception completion to the time code 1040A supplied to the CPU 40A, or by another method.

Figure 5A:
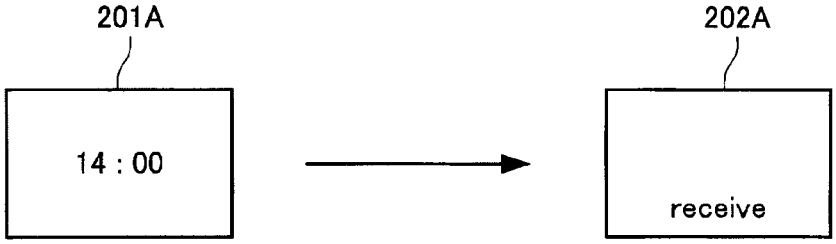
FIG. 5A, FIG. 5B, and FIG. 5C show examples of a display showing that signal reception is in progress in the first embodiment of the invention.
Figure 5B:
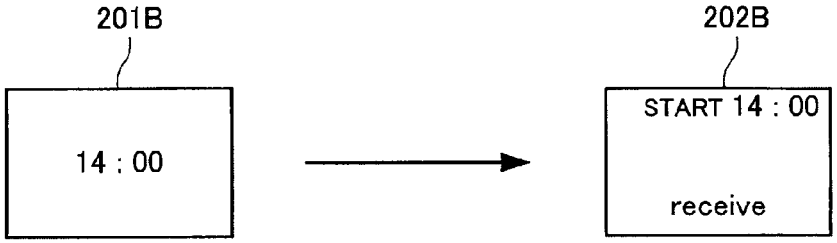
Figure 5C:
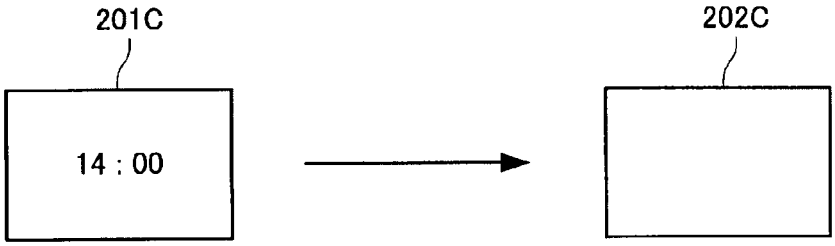

FIG. 5A, FIG. 5B, and FIG. 5C show examples of ways of indicating that reception is in progress in the first embodiment of the invention.

In FIG. 5A, FIG. 5B, and FIG. 5C reference numerals 201A, 201B, and 201C show the display content of the EPD panel during normal operation, that is, when signals are not to be received. Step S1 in FIG. 4 causes the normal screens 201A, 201B, and 201C to change to the screens 202A, 202B, and 202C, respectively, and screens 202A, 202B, and 202C remain displayed during steps S2 and S3 in FIG. 4.

In the first embodiment of the invention the current time is displayed in the normal screens 201A, 201B, and 201C.

Screen 202A is one example of a display indicating that reception is in progress. In screen 202A the current time is not displayed, and a message such as "receive" is displayed so that the user does not mistakenly think there has been a device malfunction. Note that instead of or in addition to displaying such a verbal message to indicate that reception is in progress, an icon such as an antenna, a special symbol, a graphic, or a picture, for example, may be displayed.

Screen 202B is another example of a display indicating that reception is in progress. In screen 202B the time is displayed together with a word such as "START" at a different location on screen than where the time is usually displayed, and a message such as "receive" is also displayed so that the user does not mistakenly think there has been a device malfunction. Because supply of the drive signal 3020A is stopped (S2 in FIG. 4) while screen 202B is displayed, the current time is not accurately displayed. However, because START is also displayed, the user can know that signal reception started at 14:00 and is prevented from mistaking the displayed time for the correct current time. The user can therefore determine the current time in this situation by estimating how much time has passed since the radio-controlled timepiece entered the signal reception mode, or can compare the time with the current time displayed on a device other than the radio-controlled timepiece 1A to determine the current time with some degree of accuracy. Note that a word, symbol, graphic or other element may be displayed instead of the word START in screen 202B, or the displayed word, symbol, or graphic element, for example, may be changed according to the current conditions. For example, a radio-controlled timepiece may receive the standard time signal automatically at the same preset time each day, or the user may manually start reception unconditionally at any given time during the day. As a result, "automatic reception" or "manual reception", for example, may be appropriately displayed to differentiate these reception modes instead of displaying START.

Screen 202C is yet another example of a display indicating that reception is in progress. To prevent the user from thinking a device malfunction has occurred in this example, the time is erased from the display and the screen is rewritten to a single specific display color to inform the user that reception is in progress. As a result, the user can know that reception is in progress and not think that an electronic device failure has occurred even though a message such as "receive" is not displayed.

Figure 6:
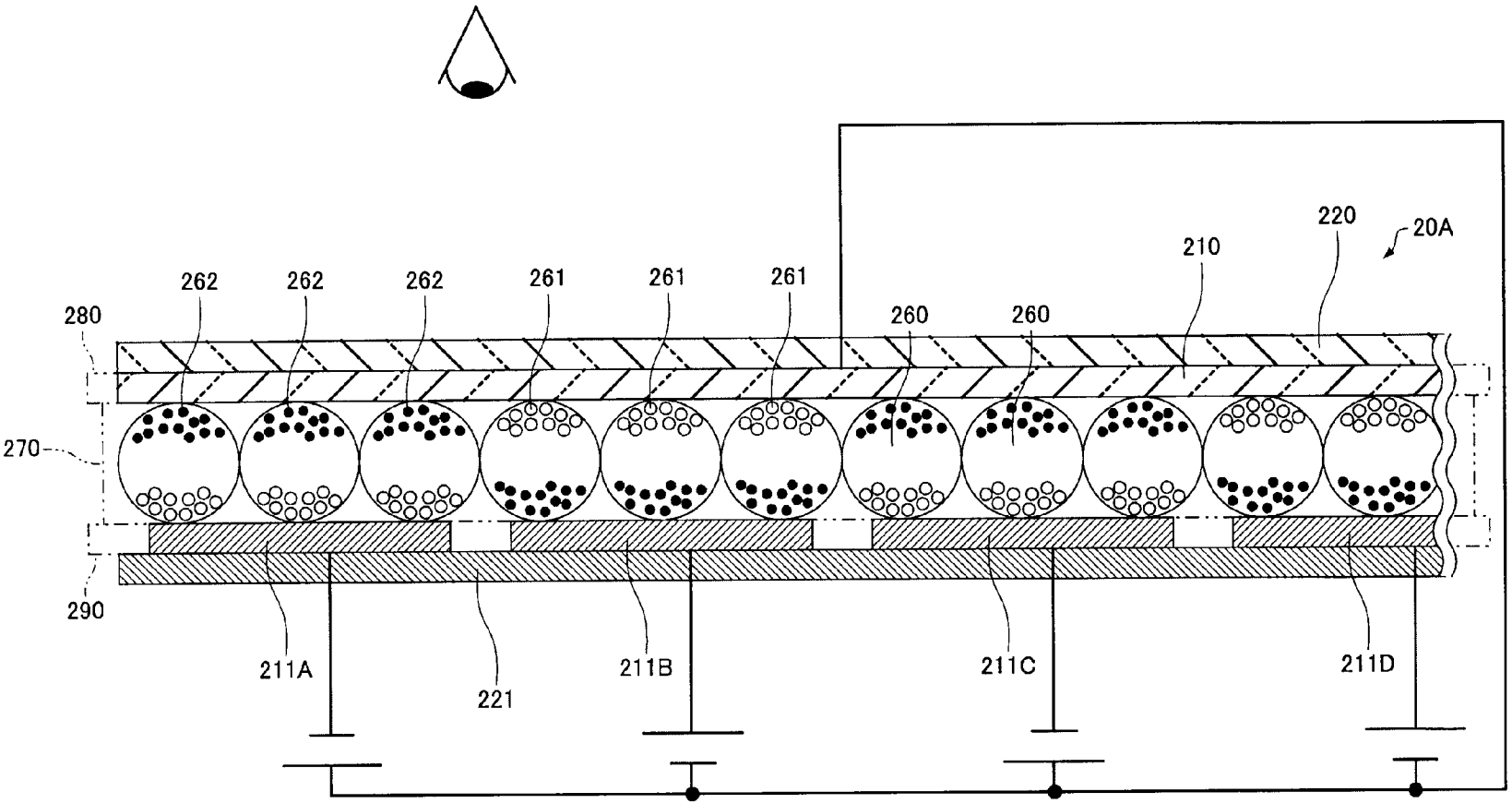
FIG. 6 shows the configuration of an electrophoretic display unit in a first embodiment of the invention.

FIG. 6 describes the configuration of an EPD panel 20A in the first embodiment of the invention. FIG. 6 is a section view of the EPD panel 20A. The electrophoretic elements 260 can be seen by the user through a transparent common electrode 210 and opposing substrate 220. More specifically, the common electrode 210 and opposing substrate 220 are disposed on the crystal 102 side of the timepiece in FIG. 3B. Note that in FIG. 3B the EPD panel 20A is included in the display substrate 101.

The EPD panel 20A shown in FIG. 6 is rendered by an electrophoretic display layer 270 containing the electrophoretic elements 260 between a common electrode layer 280 where the common electrode 210 is formed, and a drive electrode layer 290 where the segment electrodes (drive electrodes) 211A, 211B, 211C, 211D for driving the electrophoretic display layer 270 are formed. In addition, a substrate 221 is disposed on the opposite side as the opposing substrate 220 made from a transparent material such as glass or plastic.

In the EPD panel 20A shown in FIG. 6, segment electrodes (drive electrodes) 211A, 211B, 211C, 211D composed of a plurality of segmented electrodes are disposed on the back substrate 221 side, and a common electrode 210 made of a transparent conductive material such as ITO (indium tin oxide) with high light transmittance and low electrical resistance on the opposing substrate side. The electrophoretic elements 260 (microcapsules) containing charged electrophoretic particles are disposed between the common electrode 210 and the segment electrodes 211A, 211B, 211C, 211D. White particles 261, which are positively charged electrophoretic particles, and black particles 262, which are negatively charged electrophoretic particles, are sealed in the electrophoretic elements 260. When the drive signal 3020A output from the EPD driver 30A is applied, the content displayed on the EPD panel 20A changes or is refreshed. The drive signal 3020A corresponding to the information to be displayed is applied to the common electrode 210 and to the segment electrodes 211A, 211B, 211C, 211D. In the example shown in FIG. 6, a potential lower than the common electrode 210 is applied to segment electrodes 211A and 211C, and a potential greater than the common electrode 210 is applied to segment electrodes 211B and 211D. This produces an electrical field between the segment electrodes 211A, 211B, 211C, 211D and the common electrode 210, causing the white particles 261 in the electrophoretic elements 260 to migrate to the electrode on the relatively negative potential side, and the black particles 262 to migrate to the electrode on the relatively positive potential side.

The EPD panel 20A in this embodiment of the invention can display at least two colors. More specifically, the white color of the positively charged white particles 261 can be displayed as a first color, and the black color of the negatively charged black particles 262 can be displayed as a second color. As a result, either the first color or the second color can be assigned as the single specific display color that may be used to indicate that reception is in progress. Note, further, that the colors of the charged particles are not limited to black and white, and other colors such as blue and yellow may be used instead. In such a configuration the color of the positively charged particles may be assigned as the first color or second color, and the color of the negatively charged particles may be assigned as the other color.

Note, further, that the first color and second color are not limited to the colors of the electrophoretic particles. For example, in a single-particle electrophoretic display system the first color may be the color of the electrophoretic particles, and the second color may be the color of the colored medium in which the electrophoretic particles are dispersed (the suspension fluid).

Note that when the electric field (applying potential to the electrodes) is stopped in FIG. 6, the displayed content continues to be displayed due to the characteristics of the EPD panel 20A. However, it is also known from experience that if a potential is not applied for an extended period of time, the charged electrophoretic particles tend to migrate back toward the middle of the electrophoretic elements 260. Applying potential to the screen electrodes is stopped while the indication that reception is in progress is displayed (S2 in FIG. 4), and the display contrast of the EPD panel 20A may drop after a long time. A degraded display appearance caused by reduced contrast can be prevented in this situation, however, by using the color of one of the charged electrophoretic particles as the display color indicating that reception is in progress. This is because even if some of the charged electrophoretic particles are drawn back to the middle of the electrophoretic elements 260, the user will continue to see an image composed of the specified single display color because charged particles of the single specified display color form multiple particle layers near the common electrode 210 where the displayed image is seen by the user.

Figure 7:
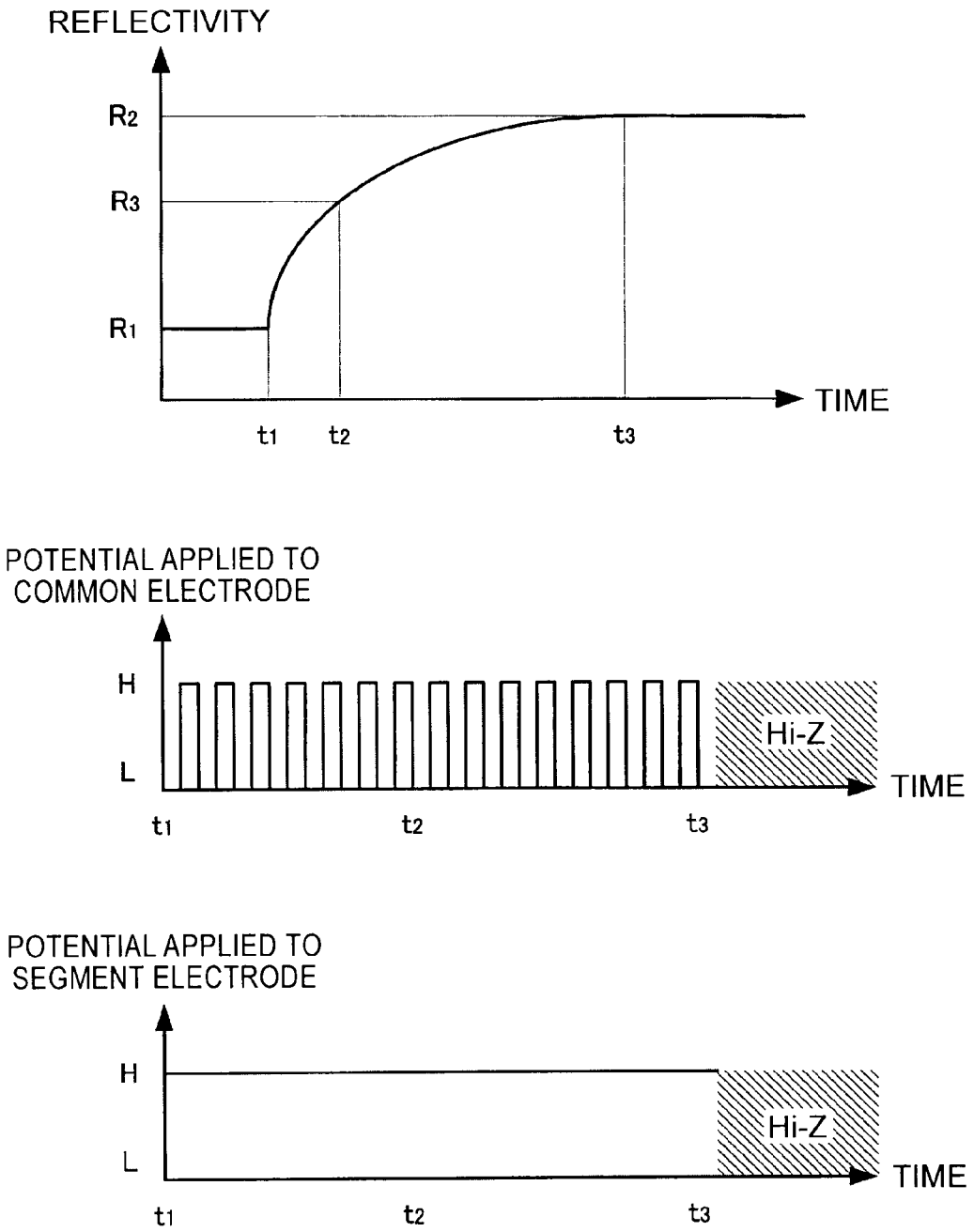
FIG. 7 illustrates the change in one segment of the electrophoretic display unit in a first embodiment of the invention.

FIG. 7 shows the change in one segment of the electrophoretic display unit in the first embodiment of the invention.

The EPD driver 30A in the first embodiment displays content on the screen of the EPD panel 20A by driving the common electrode and segment electrodes (drive electrodes) by means of the drive signal 3020A as described below. Note that pixel electrodes are used instead of segment electrodes in an active matrix EPD panel 20A, but the same control method can be used. Note, further, that segment electrode 211B is selected from among the segment electrodes 211A, 211B, 211C, 211D in FIG. 6 and used as an example below.

At time $t_1$ the segment is in a low reflectivity R1 state, and the color (second color) of the black particles 262, which are the negatively charged particles, is displayed for the user. Until time $t_3$ the EPD driver 30A then applies common electrode drive pulses (see the middle row in FIG. 7) that switch between a first potential (applied potential L in the middle row in FIG. 7) and a second potential (applied potential H in the middle row in FIG. 7) to the common electrode 210 of the EPD panel 20A. Also until time $t_3$, the EPD driver 30A applies the second potential to the segment electrode 211B (bottom row in FIG. 7) of the EPD panel 20A. Thus, when the common electrode drive pulse is the first potential, an electric field is produced between the common electrode 210 and the segment electrode 211B, the white particles 261, which are the positively charged electrophoretic particles, migrate to the common electrode 210 side, and the black particles 262, which are the negatively charged electrophoretic particles, migrate to the segment electrode 211B side. At time $t_3$, the segment changes to a high reflectivity R2 state. The color (first color) of the white particles 261 that are the positively charged electrophoretic particles is displayed for the user at this time. After time $t_3$, the EPD driver 30A can stop applying the common electrode drive pulse and the second potential to the common electrode 210 and segment electrode 211B, and the drive signal 3020A may go to a high impedance (H-Z) state. This segment is also thereafter held in the high reflectivity R2 state due to the characteristics of the EPD panel 20A.

Note, further, that the relationship between the drive signal 3020A and changing the content displayed by one segment is described for brevity above, but a display indicating that reception is in progress can be presented by displaying a single specific display color in all segments by controlling the voltage applied to each of the segments of the EPD panel 20A as described above.

Figure 8:
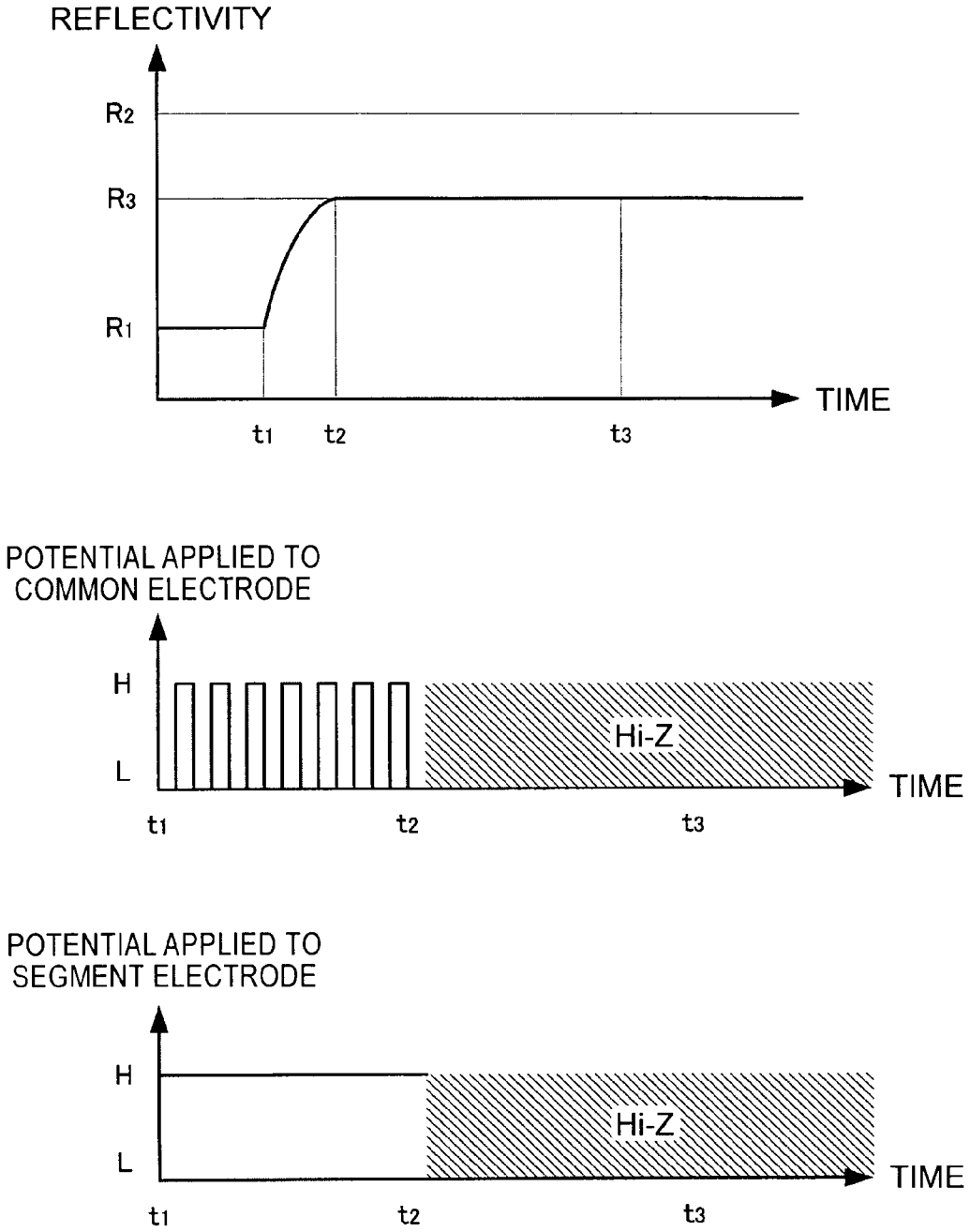
FIG. 8 illustrates the change in one segment of the electrophoretic display unit in a first embodiment of the invention.

FIG. 8 shows another example of the change in one segment of the electrophoretic display unit in the first embodiment of the invention.

Compared with FIG. 7, the EPD driver 30A stops applying the common electrode drive pulse and the second potential at a time $t_2$ before time $t_3$. As a result, the color displayed by an intermediate reflectivity R3 that is between the low reflectivity R1 and the high reflectivity R2, or more specifically a gray color between the color of the black particles 262 (second color) and the color of the white particles 261 (first color) is displayed. A desired gray level color can thus be displayed by adjusting the time for which the EPD driver 30A applies the common electrode drive pulse and the second potential to the common electrode 210 and segment electrode 211B. In addition, by controlling the voltage applied to each segment of the EPD panel 20A in the same way, a display indicating that reception is in progress can be presented using a specific single intermediate color.

If supply of the drive signal 3020A is stopped for a long time when the single specific display color used to indicate that reception is in progress is an intermediate color between the first color and second color, some of the electrophoretic particles can also move away from near the surface of the electrophoretic display unit. The color presented on the display of the electrophoretic display unit may therefore also change, but this change is difficult for the user to discern because it is a change from one intermediate color to another intermediate color. An apparent drop in the appearance of the display can therefore be prevented even if supply of the drive signal from the display drive unit is stopped for a long time.

The drive signal 3020A from the EPD driver 30A in this first embodiment of the invention includes the voltage applied to each segment and the common electrode drive pulse. The common electrode drive pulse can control driving the EPD panel 20A by means of two potentials, a first potential corresponding to ground (GND) (applied potential L in FIG. 7 and FIG. 8), and a second potential (applied potential H in FIG. 7 and FIG. 8).

The second potential, however, is typically +15 V, for example, and is a higher voltage than used in an LCD device. As a result, the common electrode drive pulse is potentially the greatest source of noise during RF signal reception. Therefore, when the EPD driver 30A supplies a common electrode drive pulse alternating between the first potential and second potential to the common electrode 210, the CPU 40A may control the EPD driver 30A to stop supplying the common electrode drive pulse while the reception unit 10 is receiving radio signals.

As a result, high sensitivity signal reception can be achieved by stopping the common electrode drive pulse that can be an important cause of noise during signal reception.

*Embodiment 2

Figure 9:
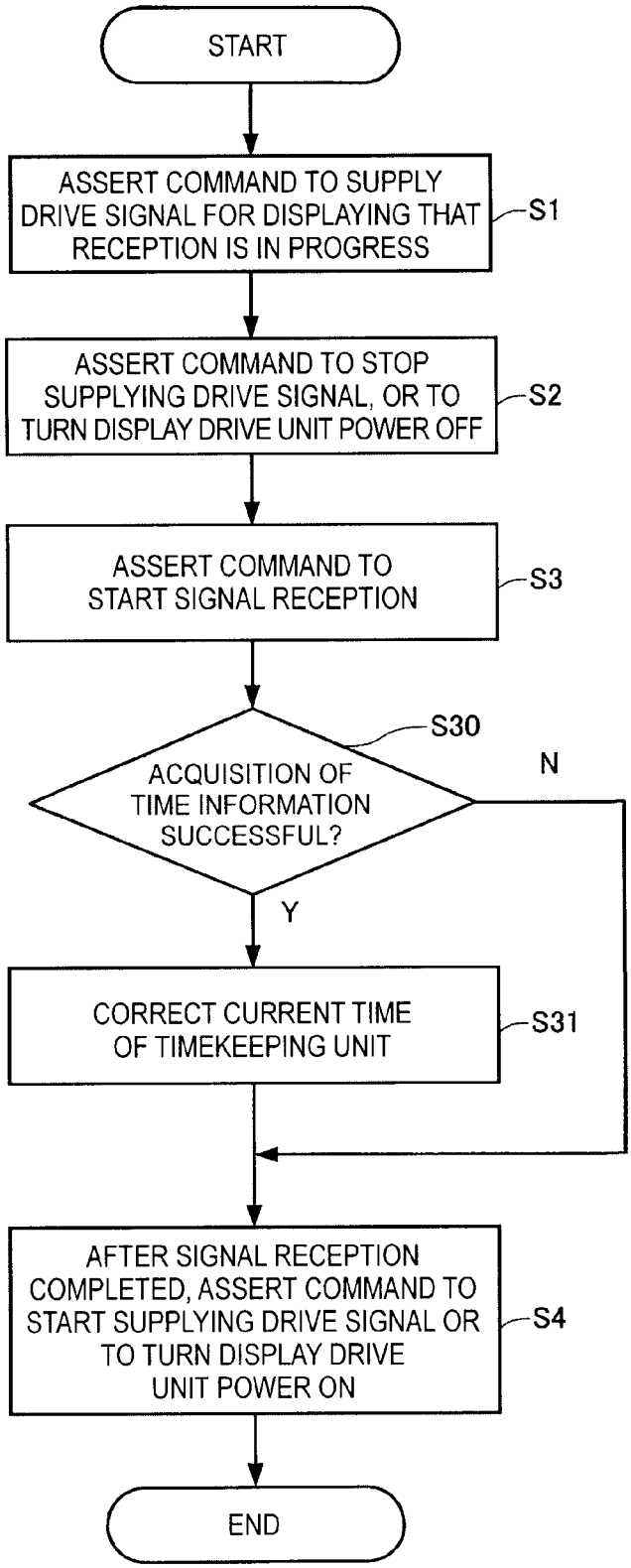
FIG. 9 is a flow chart of the control unit in a second embodiment of the invention.

FIG. 9 is a flow chart showing a process executed by the control unit in a second embodiment of the invention.

The configuration of the radio-controlled timepiece according to the second embodiment of the invention is the same as shown in FIG. 2. Identical parts in the first and second embodiments are also identified by the same reference numerals in FIG. 2, FIG. 5, and FIG. 6. Identical steps in the control method are also identified by the same reference numerals in FIG. 4 and FIG. 9, and further description thereof is omitted or simplified.

The RF signal in this second embodiment of the invention is a long-wave standard time signal. The CPU 40A executes steps S1, S2, and S3 described in FIG. 4. The CPU 40A then acquires the time code 1040A from the reception circuit 110 of the reception unit 10, and determines if the standard time information was correctly acquired (S30). If the CPU 40A determines that the reception unit 10 successfully acquired the standard time information, the CPU 40A applies the timekeeping control signal 4060 to adjust the current time kept by the timekeeping unit 60 based on the standard time information (S31).

After the reception unit 10 finishes receiving the long-wave standard time signal, the CPU 40A controls the EPD driver 30A to resume supplying the drive signal 3020A for displaying the current time (S4). At this time, if the current time kept by the timekeeping unit 60 was corrected (S31), the internal time information signal 6030 reflects the standard time information and the correct current time will be displayed on the EPD panel 20A after supplying the drive signal 3020A resumes.

Figure 10:
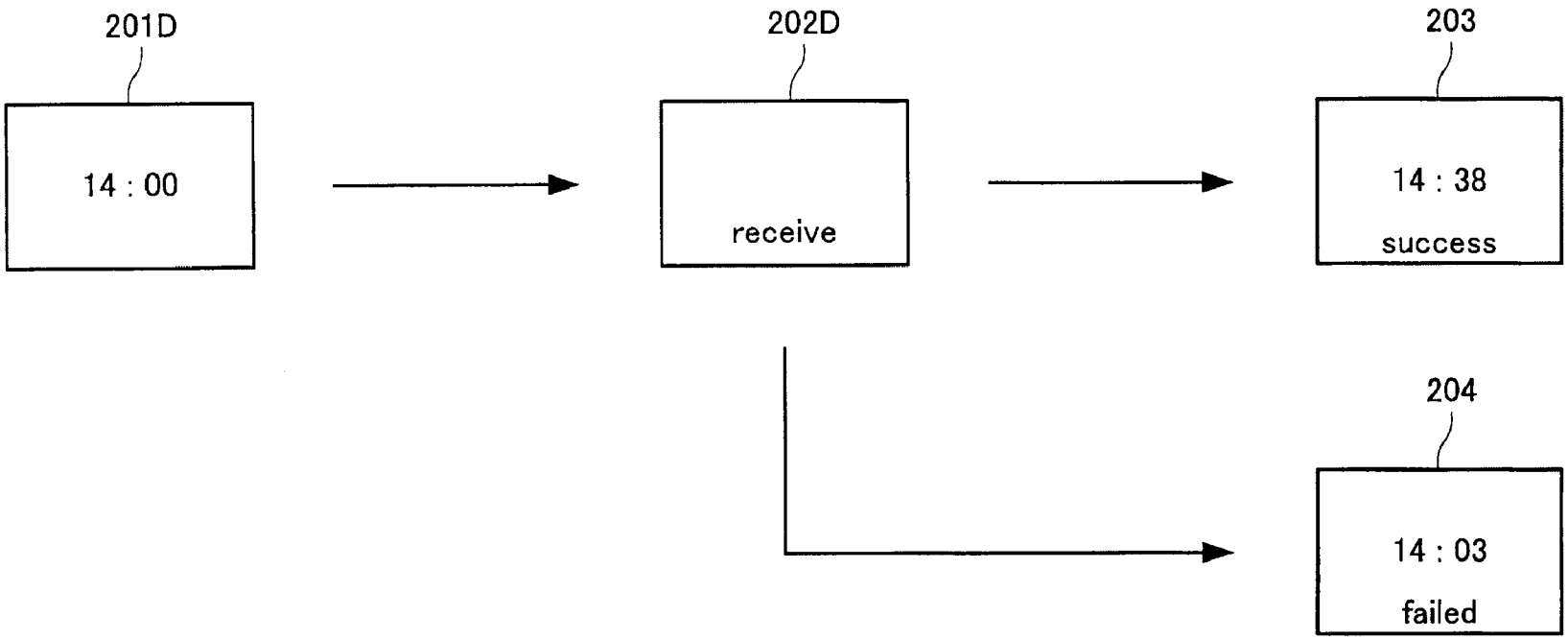
FIG. 10 shows an example of a display showing that signal reception is in progress in the second embodiment of the invention.

FIG. 10 shows the change in the displayed content in this second embodiment of the invention.

The screen of the EPD panel 20A normally appears as shown in screen 201D, that is, when signal reception is not in progress. In this example the correct time before signal reception is 14:35, the time displayed on the radio-controlled timepiece 1A is 35 minutes slow, and the internal time is set to 14:00. Step S1 in FIG. 9 causes the screen to change the screen 202D informing the user that signal reception is in progress. Screen 202D continues to be displayed until step S4 in FIG. 9 starts. Note that instead of or in addition to displaying such a verbal message to indicate that reception is in progress, an icon such as an antenna, a special symbol, a graphic, or a picture, for example, may be displayed.

While causing the EPD driver 30A to continue displaying the drive signal 3020A corresponding to screen 202D, the CPU 40A makes the decision shown in step S30 in FIG. 9. If a step of comparing the time acquired from two standard time signals is included in order to improve the reliability of the success decision, at least two minutes, or more specifically approximately three minutes, is required because the information carried in the long-wave standard time signal changes every minute.

If reception is determined successful, the current time kept by the timekeeping unit 60 is corrected (step S31 in FIG. 9), and the correct current time of 14:38 including the three minutes required for successful reception is displayed (screen 203 in FIG. 10). Note that a message such as "success" may also be displayed to notify the user that reception was successful.

If the standard time information could not be acquired, the time is not adjusted by the CPU 40A, and the current time kept by the timekeeping unit 60 is displayed incremented appropriately from the time that was displayed before reception started (screen 204 in FIG. 10). Note that a message such as "failed" may also be displayed to notify the user that the standard time information could not be acquired.

In addition to the effects of the first embodiment, this second embodiment can also display the correct time based on the time information contained in the received RF signal if acquiring the time information is successful.

3. Examples of Other Electronic Devices

Figure 11A:
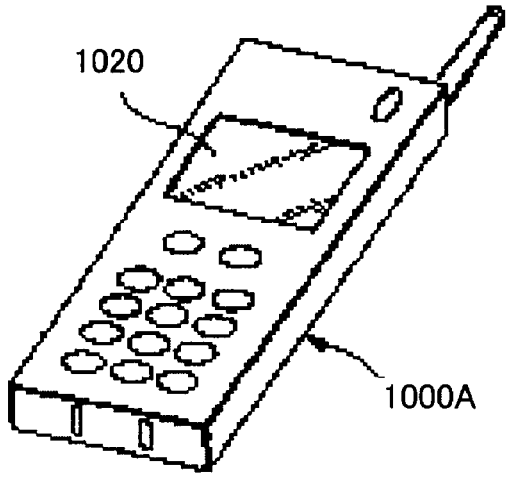
FIG. 11A shows a cell phone as an example of an electronic device.
Figure 11B:
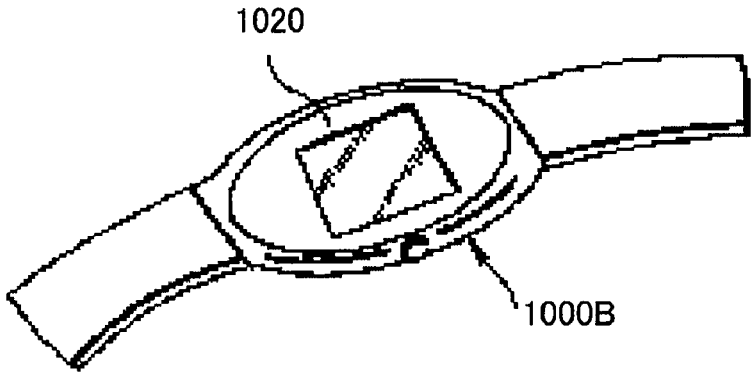
FIG. 11B shows a wristwatch with a communication function as an example of an electronic device.
Figure 11C:
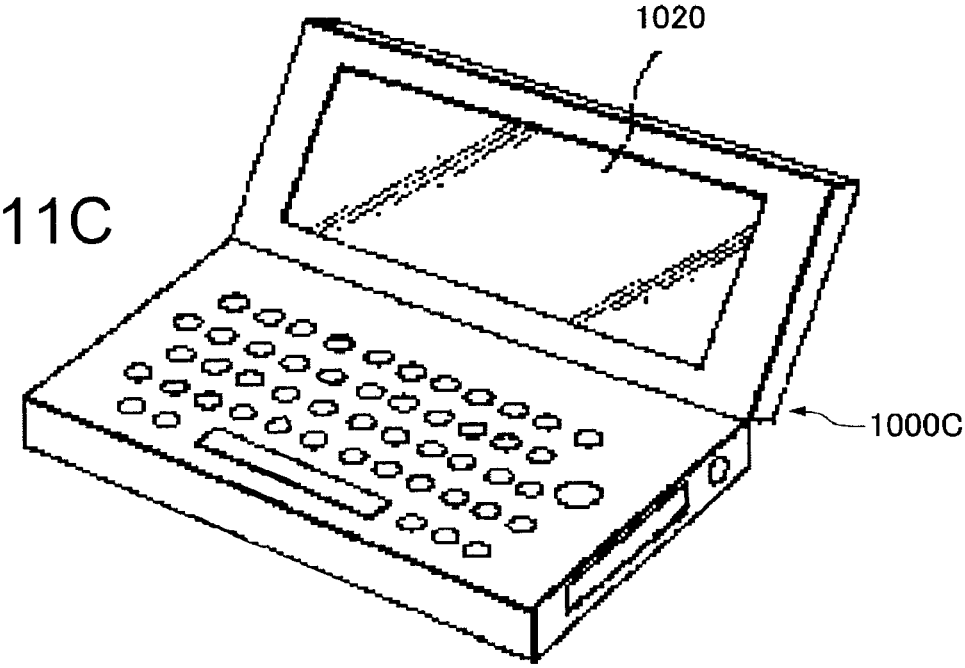
FIG. 11C shows a notebook computer as an example of an electronic device.

FIG. 11A, FIG. 11B, and FIG. 11C show examples of other electronic devices. The EPD panel 20A of the foregoing first embodiment or second embodiment may be a part of an electronic device such as shown in FIG. 11A, FIG. 11B, and FIG. 11C, for example. More specifically, the EPD panel 20A can be used as the display panel 1020 of a cell phone 1000A, a wristwatch with a communication function 1000B, or a notebook computer 1000C.

Each of these electronic devices has a control unit, and as a result of the control unit instructing the display drive unit to supply a drive signal related to displaying indication that reception is in progress before instructing the reception unit to start signal reception, the electronic devices can continue displaying for the user indication that reception is in progress even though the display drive unit stops supplying the drive signal while reception is in progress. Because the display indicates that reception is in progress at this time, the user is prevented from worrying about a device failure, supplying the drive signal that can cause noise to the electrophoretic display unit can be stopped regardless of the current time, and signals can be received with high reception sensitivity.

The invention includes configurations that are practically identical to the configurations of the embodiments described above, including configurations with the same function, method, and effect, and configurations with the same object and effect. The invention also includes configurations that replace parts that are not essential to the configuration of the embodiments described above. The invention also includes configurations that have the same operational effect and configurations that achieve the same object as the configurations described above. The invention also includes configurations that add technology known from the literature to the configurations of the foregoing embodiments.

What is claimed is:

1. An electronic device that receives a radio signal according to specific conditions and displays specific information, comprising:

a reception unit that receives the radio signal;

an electrophoretic display unit that displays the specific information;

a display drive unit that supplies a drive signal corresponding to content of the specific information to be displayed to the electrophoretic display unit; and a control unit that instructs the reception unit to receive the radio signal and instructs the display drive unit to supply the drive signal to the electrophoretic display unit, instructs the display drive unit to supply a drive signal for displaying an indication that the reception unit is receiving the radio signal to the electrophoretic display unit before instructing the reception unit to receive the radio signal, and controls the display drive unit to stop supplying the drive signal while the reception unit is receiving the radio signal.

2. The electronic device described in claim 1, wherein:

the electronic device further comprises a power supply unit that supplies electric power to the display drive unit; and the control unit stops the display drive unit from supplying the drive signal while the reception unit is receiving the radio signal by instructing the power supply unit to stop supplying power to the display drive unit.

3. The electronic device described in claim 1, wherein:

the electrophoretic display unit can display at least a first color and a second color; and the first color or the second color is displayed over the entire display to indicate that signal reception is in progress.

4. The electronic device described in claim 1, wherein:

the electrophoretic display unit can display at least a first color, a second color, and an intermediate color of the first color and second color; and the intermediate color is displayed over the entire display to indicate that signal reception is in progress.

5. The electronic device described in claim 1, wherein:

the electronic device further comprises a timekeeping unit for keeping the current time;

the reception unit receives a radio signal containing time information;

the electrophoretic display unit displays the current time as the specific information; and the control unit adjusts the current time kept by the timekeeping unit based on the received time information, and controls the display drive unit to resume supplying the drive signal related to displaying the current time after the reception unit completes reception of the radio signal, when acquisition of the time information by the reception unit is determined successful.

6. The electronic device described in claim 1, wherein:

the electrophoretic display unit is an electrophoretic display panel that has an electrophoretic display layer containing electrophoretic elements disposed between a common electrode layer where a common electrode is formed, and a drive electrode layer where a drive electrode for driving the electrophoretic display layer is formed;

the display drive unit supplies common electrode drive pulses repeating a first potential and a second potential to the common electrode; and the control unit controls the display drive unit to stop supplying the common electrode drive pulses while the reception unit is receiving the radio signals.

7. A control method for an electronic device that uses a reception unit to receive radio signals and displays specific information on an electrophoretic display unit using a drive signal supplied from a display drive unit, comprising:

instructing the reception unit to receive the radio signal, and instructing the display drive unit to supply the drive signal to the electrophoretic display unit; and instructing the display drive unit to supply a drive signal for displaying an indication that the reception unit is receiving the radio signal to the electrophoretic display unit before instructing the reception unit to receive the radio signal, and controlling the display drive unit to stop supplying the drive signal while the reception unit is receiving the radio signal, when the reception unit is instructed to receive the radio signal.

* * * * *